US011545097B1

(12) United States Patent
Wu

(10) Patent No.: US 11,545,097 B1
(45) Date of Patent: Jan. 3, 2023

(54) LIQUID-CRYSTAL DISPLAY AND AN OVERDRIVE SYSTEM THEREOF

(71) Applicant: Himax Technologies Limited, Tainan (TW)

(72) Inventor: Tung-Ying Wu, Tainan (TW)

(73) Assignee: Himax Technologies Limited, Tainan (TW)

( * ) Notice: Subject to any disclaimer, the term of this patent is extended or adjusted under 35 U.S.C. 154(b) by 0 days.

(21) Appl. No.: 17/563,508

(22) Filed: Dec. 28, 2021

(51) Int. Cl.
*G09G 3/36* (2006.01)
*G09G 5/00* (2006.01)

(52) U.S. Cl.
CPC ..... *G09G 3/36* (2013.01); *G09G 2310/0243* (2013.01); *G09G 2310/08* (2013.01); *G09G 2320/04* (2013.01); *G09G 2340/02* (2013.01)

(58) Field of Classification Search
CPC ..... G06F 3/038; G09G 5/00; G09G 5/10; G09G 5/39; G09G 5/393; G09G 5/395; G09G 3/20; G09G 3/36; G09G 3/132; G09G 3/136; G09G 3/176; G09G 3/196; G09G 2310/0243; G09G 2310/08; G09G 2320/04; G09G 2340/02; H04N 19/00; H04N 19/14; H04N 19/17; H04N 19/41; H04N 19/42; H04N 19/52; H04N 19/64; H04N 19/91; H04N 19/156; H04N 19/147; H04N 19/105; H04N 19/124; H04N 19/146; H04N 19/423; H04N 19/137; H04N 19/119; H04N 19/172; H04N 7/00; H04N 7/12; H04N 7/26; G06T 5/50; G06K 9/00; G06K 9/36; G06K 9/40; G06K 9/46
See application file for complete search history.

(56) References Cited

U.S. PATENT DOCUMENTS

2006/0164365 A1* 7/2006 Huang ..... G09G 3/36 345/98
2009/0027410 A1* 1/2009 Inuzuka ..... H04N 19/176 345/530
2016/0078849 A1* 3/2016 Furihata ..... G09G 3/3406 345/88
2018/0374450 A1* 12/2018 Kanovsky ..... G09G 5/395

* cited by examiner

*Primary Examiner* — Chanh D Nguyen
*Assistant Examiner* — Nguyen H Truong
(74) *Attorney, Agent, or Firm* — Donald E. Stout; Stout, Uxa & Buyan, LLP

(57) ABSTRACT

An overdrive system includes a compressor that compresses an input signal to result in a compressed signal; a weighting device that generates a weighted sum of a current compressed signal and a current input signal, thereby resulting in a weighted current signal; and an overdriver that performs an overdrive operation according to a previous compressed signal and the weighted current signal.

14 Claims, 4 Drawing Sheets

OD lookup table

| | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 17 | 16 | 14 | 13 | 16 | 9 | 8 | 7 | 6 | 5 | 3 | 0 | 0 | 0 | 0 | 0 | 0 |
| 32 | 39 | 33 | 32 | 29 | 28 | 26 | 25 | 25 | 23 | 23 | 23 | 22 | 21 | 20 | 21 | 18 | 0 |
| 48 | 57 | 55 | 51 | 48 | 44 | 42 | 40 | 40 | 38 | 37 | 35 | 34 | 32 | 31 | 32 | 26 | 12 |
| 64 | 76 | 72 | 69 | 67 | 64 | 60 | 58 | 57 | 55 | 54 | 51 | 49 | 48 | 47 | 52 | 47 | 20 |
| 80 | 91 | 91 | 90 | 87 | 85 | 80 | 76 | 74 | 71 | 69 | 67 | 66 | 64 | 62 | 62 | 80 | 80 |
| 96 | 113 | 109 | 107 | 104 | 102 | 99 | 96 | 92 | 89 | 88 | 87 | 84 | 80 | 75 | 78 | 96 | 96 |
| 112 | 131 | 126 | 123 | 123 | 118 | 117 | 115 | 112 | 107 | 105 | 104 | 101 | 99 | 94 | 94 | 83 | 77 |
| 128 | 146 | 142 | 139 | 137 | 135 | 134 | 131 | 130 | 128 | 124 | 121 | 120 | 118 | 116 | 113 | 114 | 94 |
| 144 | 163 | 159 | 156 | 155 | 153 | 151 | 149 | 148 | 146 | 144 | 139 | 138 | 136 | 133 | 133 | 113 | 100 |
| 160 | 177 | 174 | 173 | 170 | 170 | 168 | 166 | 165 | 163 | 162 | 160 | 155 | 151 | 152 | 135 | 130 | 125 |
| 176 | 192 | 190 | 189 | 187 | 187 | 185 | 185 | 182 | 180 | 179 | 177 | 176 | 170 | 170 | 159 | 155 | 150 |
| 192 | 207 | 204 | 204 | 202 | 204 | 201 | 201 | 202 | 197 | 196 | 194 | 193 | 192 | 187 | 177 | 172 | 10 |
| 208 | 221 | 219 | 218 | 219 | 221 | 216 | 216 | 215 | 213 | 213 | 211 | 210 | 209 | 208 | 200 | 194 | 190 |
| 224 | 236 | 233 | 233 | 233 | 231 | 231 | 231 | 231 | 229 | 229 | 227 | 227 | 226 | 225 | 224 | 200 | 198 |
| 240 | 244 | 245 | 246 | 246 | 246 | 246 | 246 | 246 | 245 | 245 | 243 | 243 | 242 | 242 | 241 | 240 | 236 |
| 255 | 255 | 255 | 255 | 255 | 255 | 255 | 255 | 255 | 255 | 255 | 255 | 255 | 255 | 255 | 255 | 255 | 255 |

*FIG. 4B*

LIQUID-CRYSTAL DISPLAY AND AN OVERDRIVE SYSTEM THEREOF

BACKGROUND OF THE INVENTION

1. Field of the Invention

The present invention generally relates to a display, and more particularly to an overdrive system adaptable to a liquid-crystal display.

2. Description of Related Art

A liquid-crystal display (LCD) is a flat-panel display that modulates light flow by rotating liquid-crystal molecules. However, the speed at which these liquid-crystal molecules rotate is relatively slow, commonly below the image refresh rate. As a consequence, image becomes blurry when a scene is changing fast.

An overdrive scheme is proposed to compensate for this issue by sending a higher voltage, instead of the desired voltage, to each pixel in order to drive the rotation of the liquid crystal faster.

Nevertheless, conventional overdrive systems suffer overdrive error behavior (e.g., glitter) due to compressed image, thereby greatly reducing image quality. Particularly, image quality of static (or still) image in the conventional overdrive systems suffers overdrive error behavior due to compressed image.

A need has thus arisen to propose a novel scheme adaptable to a liquid-crystal display to overcome drawbacks of the conventional overdrive systems.

SUMMARY OF THE INVENTION

In view of the foregoing, it is an object of the embodiment of the present invention to provide an overdrive system adaptable to a liquid-crystal display capable of effectively eliminating or reducing overdrive error behavior due to compressed image, thereby substantially enhancing image quality, and maintaining image quality of static (or still) image.

According to one embodiment, an overdrive system includes a compressor, a weighting device and an overdriver. The compressor compresses an input signal to result in a compressed signal. The weighting device generates a weighted sum of a current compressed signal and a current input signal, thereby resulting in a weighted current signal. The overdriver performs an overdrive operation according to a previous compressed signal and the weighted current signal.

BRIEF DESCRIPTION OF THE DRAWINGS

FIG. 4B shows an exemplary overdrive (OD) lookup table; and

DETAILED DESCRIPTION OF THE INVENTION

Figure 1:
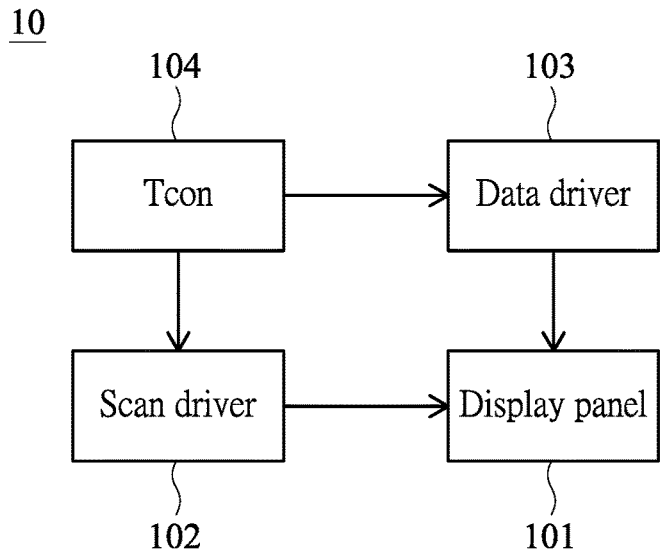
FIG. 1 shows a system block diagram illustrating a liquid-crystal display (LCD) according to one embodiment of the present invention.

FIG. 1 shows a system block diagram illustrating a liquid-crystal display (LCD) 10 according to one embodiment of the present invention. Specifically, the LCD 10 of the embodiment may include a display panel 101 composed of a plurality of pixels arranged in matrix form. The LCD 10 of the embodiment may include a scan driver (or gate driver) 102 configured to turn on in sequence at least one row of pixels of the display panel 101. The LCD 10 of the embodiment may include a data driver (or source driver) 103 configured to provide image signals to the pixels of the turned-on row of the display panel 101. The LCD 10 of the embodiment may include a timing controller (Tcon) 104 configured to controllably coordinate the scan driver 102 and the data driver 103.

Figure 2:
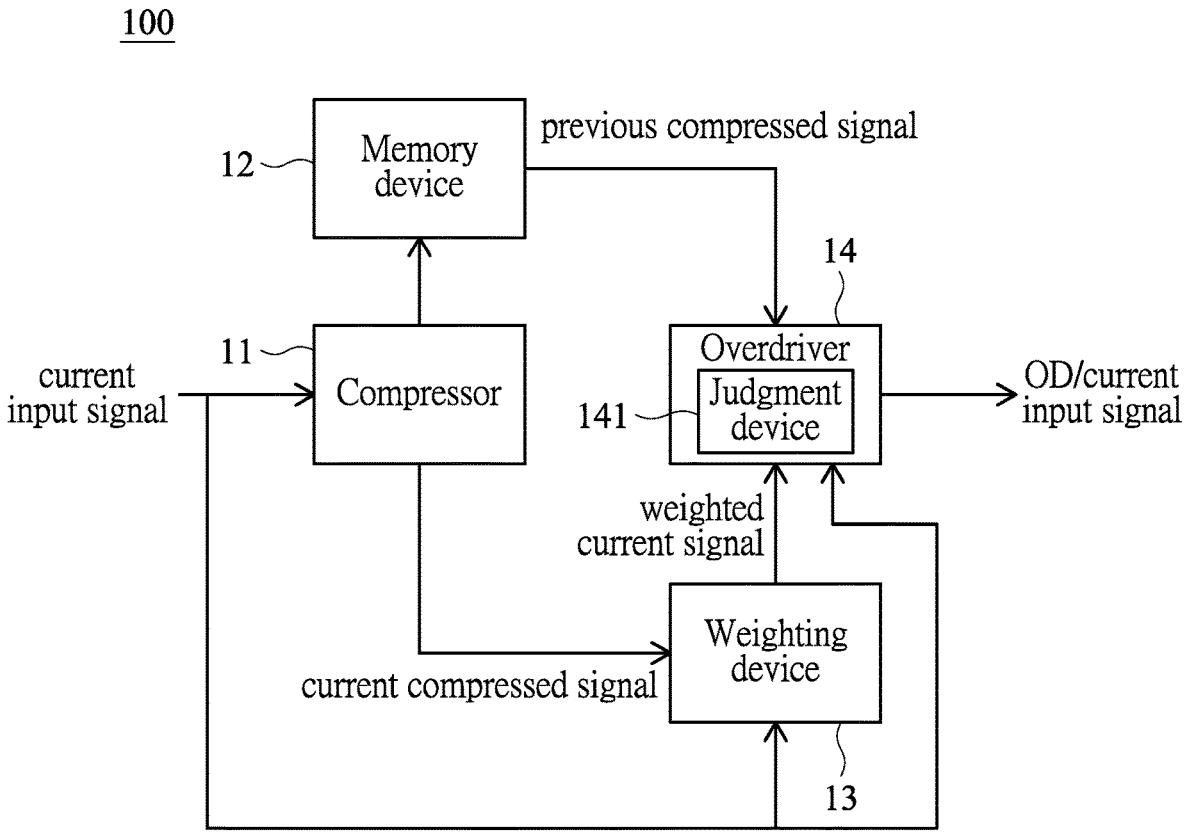
FIG. 2 shows a system block diagram illustrating an overdrive (OD) system adaptable to the timing controller of FIG. 1 according to one embodiment of the present invention.
Figure 3:
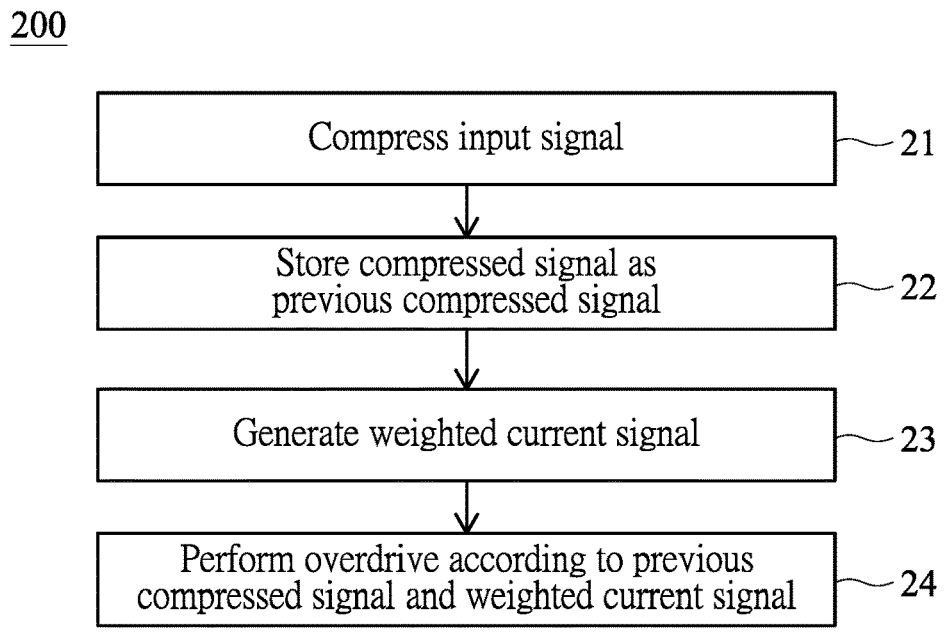
FIG. 3 shows a flow diagram illustrating an overdrive method operable in the timing controller of FIG. 1 according to one embodiment of the present invention.

FIG. 2 shows a system block diagram illustrating an overdrive (OD) system 100 adaptable to the timing controller 104 of FIG. 1 according to one embodiment of the present invention, and FIG. 3 shows a flow diagram illustrating an overdrive method 200 operable in the timing controller 104 of FIG. 1 according to one embodiment of the present invention. Blocks of FIG. 2 and steps of FIG. 3 may be implemented by hardware, software or their combination, for example, performed in an image signal processor.

In the embodiment, the overdrive system 100 may include a (data) compressor 11 configured to compress a (current) input signal (step 21) to result in a compressed signal, thereby reducing an amount of data of the input signal required to represent an image to be displayed on the display panel 101 (of FIG. 1). Specifically, an image processing operation such as smoothing may be adopted to achieve spatial continuity, facilitating following overdrive operation.

The overdrive system 100 of the embodiment may include a memory device (or buffer) 12 configured to temporarily store the compressed signal to be used as a previous (frame) compressed signal (step 22) for the following overdrive operation.

The overdrive system 100 of the embodiment may include a weighting device 13 configured, in step 23, to generate a weighted sum of a current compressed signal (of a current frame) and a current input signal (of the current frame), thereby resulting in a weighted current signal. The weighting operation performed by the weighting device 13 may be expressed as follows:

$$\text{Current_weight}=\text{Cmp_Cur}*(\text{XCError_weight})+\text{Cur}*(1-\text{XCError_weight})$$

where Current_weight represents the weighted current signal, Cmp_Cur represents the current compressed signal, Cur represents the current input signal, and XCError_weight represents a predetermined weight ranging between 0 and 1.

In one embodiment, the greater the difference between the current compressed signal (Cmp_Cur) and the current input signal (Cur), the greater the predetermined weight (i.e., closer to 1). Therefore, the weighted current signal (Current_weight) is closer to the current compressed signal (Cmp_Cur). On the other hand, the smaller the difference between the current compressed signal (Cmp_Cur) and the current input signal (Cur), the smaller the predetermined weight (i.e., closer to 0). Therefore, the weighted current signal (Current_weight) is closer to the current input signal (Cur).

The overdrive system 100 of the embodiment may include an overdriver 14 configured, in step 24, to perform an overdrive operation according to the previous compressed signal (from the memory device 12) and the weighted current signal (from the weighting device 13).

In the embodiment, the overdriver 14 may include a judgment device 141 configured to judge whether to perform an overdrive operation according to the previous compressed signal (of a previous frame) and the weighted current signal (of a current frame).

Figure 4A:
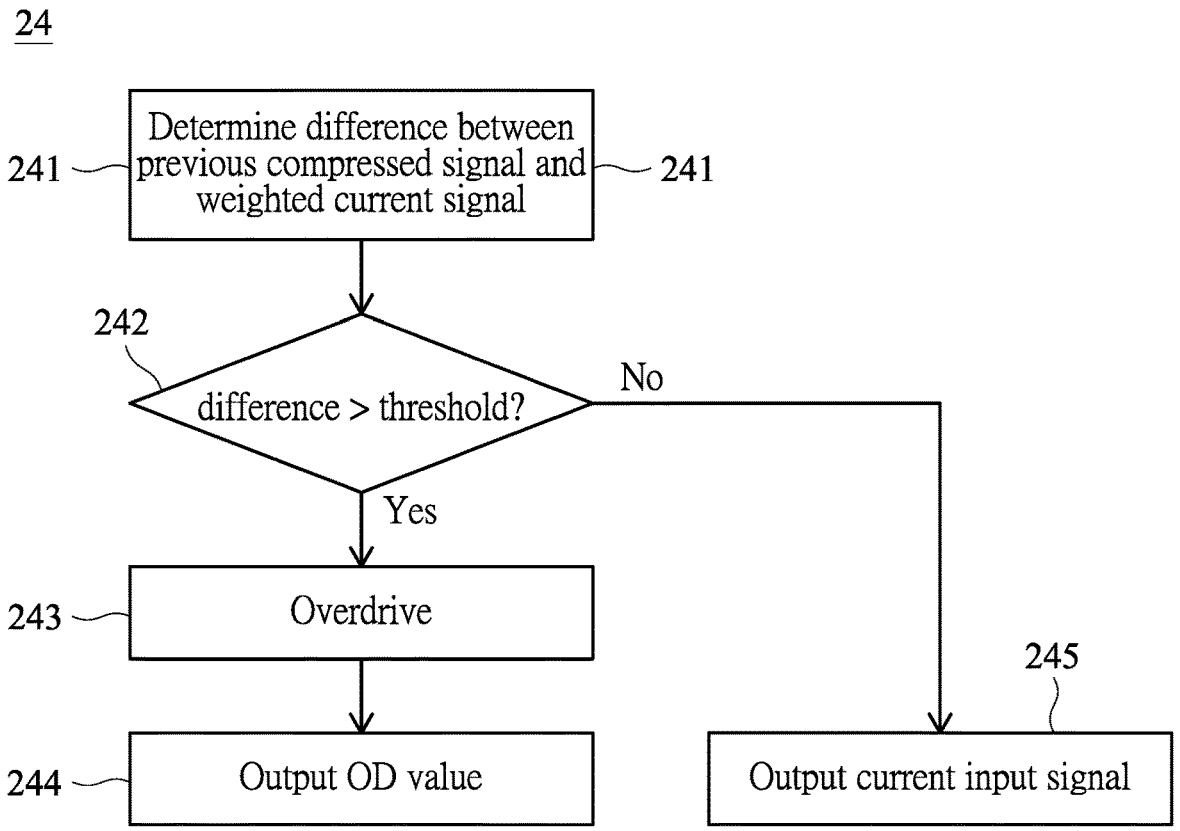
FIG. 4A shows a detailed flow diagram illustrating step 24 of FIG. 3.

FIG. 4A shows a detailed flow diagram illustrating step 24 of FIG. 3. Specifically, in step 241, a difference between the previous compressed signal (of a previous frame) and the weighted current signal (of a current frame) is determined by the judgment device 141. Next, in step 242, the difference is compared with a predetermined threshold by the judgment device 141. If the difference is greater than the predetermined threshold, an overdrive operation is enabled (by the judgment device 141) and performed (step 243), followed by outputting an overdrive (OD) value to the data driver 103 (FIG. 1) in step 244. In the embodiment, the overdrive operation (step 243) may be implemented by a lookup table. FIG. 4B shows an exemplary overdrive (OD) lookup table, from which an overdrive value may be retrieved based on the previous compressed signal (of a previous frame) and the weighted current signal (of a current frame). On the other hand, if the difference is not greater than the predetermined threshold (step 242), the overdrive operation (step 243) is skipped (i.e., not enabled) and the current input signal is outputted to the data driver 103 (step 245) instead.

According to the embodiment as disclosed above, overdrive error behavior (e.g., glitter) due to compressed image can be effectively eliminated or reduced, thereby substantially enhancing image quality. Particularly, image quality of static (or still) image may be maintained without suffering overdrive error behavior due to compressed image.

Figure 5:
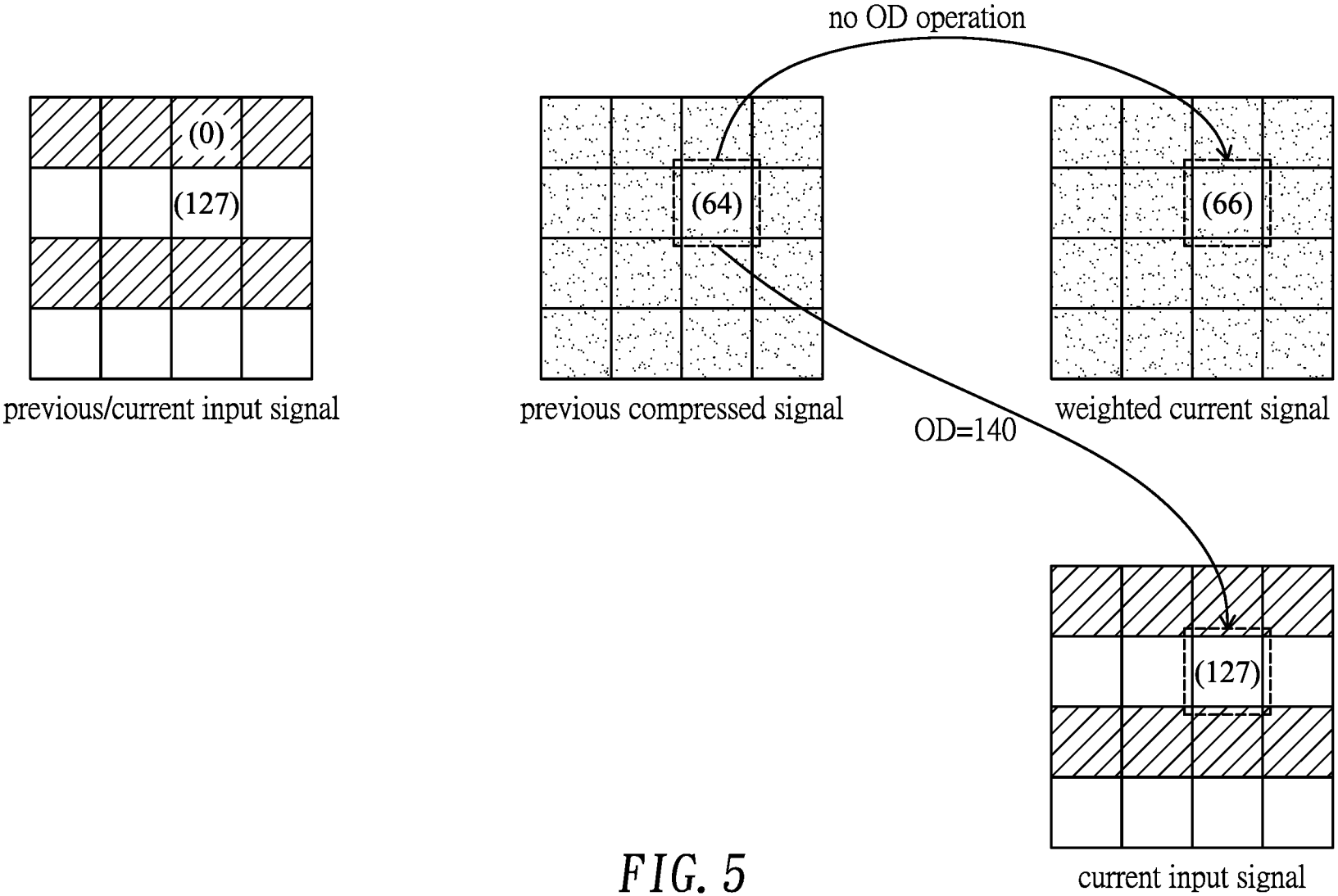
FIG. 5 schematically shows an example of static image, in which the previous input signal and the current input signal are the same.

FIG. 5 schematically shows an example of static image, in which the previous input signal and the current input signal are the same. As exemplified in FIG. 5, the previous compressed signal has a value (i.e., gray level) of 64, while the weighted current signal has a value of 66. As the difference between the previous compressed signal and the weighted current signal is not greater than the predetermined threshold (step 242), no overdrive operation is performed. On the other hand, if the weighting operation of the embodiment is not performed, an overdrive operation with the OD value of 140 will be executed, thereby resulting in glitter (i.e., overdrive error behavior due to compressed image) that significantly degrades the image quality.

Although specific embodiments have been illustrated and described, it will be appreciated by those skilled in the art that various modifications may be made without departing from the scope of the present invention, which is intended to be limited solely by the appended claims.

What is claimed is:

1. An overdrive system, comprising:

a compressor that compresses an input signal to result in a compressed signal; and an overdriver that performs an overdrive operation according to a previous compressed signal and a weighted current signal that represents a weighted sum of a current compressed signal and a current input signal.

2. The system of claim 1, further comprising:

a memory device that stores the compressed signal to be used as the previous compressed signal.

3. The system of claim 1, wherein the weighted current signal is expressed as follows:

$$\text{Current_weight}=\text{Cmp_Cur}*(\text{XCError_weight})+\text{Cur}*(1-\text{XCError_weight})$$

where Current_weight represents the weighted current signal, Cmp_Cur represents the current compressed signal, Cur represents the current input signal, and XCError_weight represents a predetermined weight.

4. The system of claim 3, wherein the greater a difference between the current compressed signal and the current input signal, the greater the predetermined weight; and the smaller the difference between the current compressed signal and the current input signal, the smaller the predetermined weight.

5. The system of claim 1, wherein the overdriver comprises a judgment device that judges whether to perform the overdrive operation according to the previous compressed signal and the weighted current signal.

6. The system of claim 5, wherein the judgment device enables the overdrive operation when a difference between the previous compressed signal and the weighted current signal is greater than a predetermined threshold, followed by outputting an overdrive value; otherwise the judgment device does not enable the overdrive operation and then outputs the current input signal.

7. The system of claim 6, wherein the overdrive value is retrieved from an overdrive lookup table based on the previous compressed signal and the weighted current signal.

8. A liquid-crystal display, comprising:

a display panel composed of a plurality of pixels;

a scan driver that turns on in sequence at least one row of pixels of the display panel;

a data driver that provides image signals to the pixels of the turned-on row of the display panel; and a timing controller that controllably coordinates the scan driver and the data driver, the timing controller including an overdrive system that comprises:

a compressor that compresses an input signal to result in a compressed signal;

an overdriver that performs an overdrive operation according to a previous compressed signal and a weighted current signal that represents a weighted sum of a current compressed signal and a current input signal.

9. The display of claim 8, wherein the overdrive system further comprises:

a memory device that stores the compressed signal to be used as the previous compressed signal.

10. The display of claim 8, wherein the weighted current signal is expressed as follows:

$$\text{Current_weight}=\text{Cmp_Cur}*(\text{XCError_weight})+\text{Cur}*(1-\text{XCError_weight})$$

where Current_weight represents the weighted current signal, Cmp_Cur represents the current compressed signal, Cur represents the current input signal, and XCError_weight represents a predetermined weight.

11. The display of claim 10, wherein the greater a difference between the current compressed signal and the current input signal, the greater the predetermined weight; and the smaller the difference between the current compressed signal and the current input signal, the smaller the predetermined weight.

12. The display of claim 8, wherein the overdriver comprises a judgment device that judges whether to perform the overdrive operation according to the previous compressed signal and the weighted current signal.

13. The display of claim 12, wherein the judgment device enables the overdrive operation when a difference between the previous compressed signal and the weighted current signal is greater than a predetermined threshold, followed by outputting an overdrive value to the data driver; otherwise the judgment device does not enable the overdrive operation and then outputs the current input signal to the data driver.

14. The display of claim 13, wherein the overdrive value is retrieved from an overdrive lookup table based on the previous compressed signal and the weighted current signal.

* * * * *